US007748310B2

(12) United States Patent
Kennedy

(10) Patent No.: US 7,748,310 B2
(45) Date of Patent: Jul. 6, 2010

(54) LINER RETENTION SYSTEM

(75) Inventor: George Coulter Kennedy, Renfrewshire (GB)

(73) Assignee: Spickey Valves and Pumps Limited, Renfrewshire, Kilmacolm (GB)

( * ) Notice: Subject to any disclaimer, the term of this patent is extended or adjusted under 35 U.S.C. 154(b) by 194 days.

(21) Appl. No.: 12/214,056

(22) Filed: Jun. 16, 2008

(65) Prior Publication Data

US 2008/0279683 A1 Nov. 13, 2008

Related U.S. Application Data

(63) Continuation of application No. 10/558,439, filed as application No. PCT/GB2004/002253 on May 26, 2004, now abandoned.

(30) Foreign Application Priority Data

May 29, 2003 (GB) ..... 0312249.6

(51) Int. Cl.
*F04B 53/00* (2006.01)
*F04B 53/16* (2006.01)

(52) U.S. Cl. ..... 92/171.1; 92/128

(58) Field of Classification Search ..... 92/128, 92/129, 171.1
See application file for complete search history.

(56) References Cited

U.S. PATENT DOCUMENTS 3,438,334 A 4/1969 Schaaf
4,550,646 A 11/1985 Miller
5,167,182 A 12/1992 Sims
5,572,920 A 11/1996 Kennedy et al.
6,209,445 B1 * 4/2001 Roberts et al. ..... 92/128
RE37,483 E 12/2001 Kennedy et al.
6,929,287 B2 8/2005 Flindall et al.

FOREIGN PATENT DOCUMENTS

DE 2356604 A1 5/1975
DE 3218000 A1 11/1983

OTHER PUBLICATIONS

International Search Report in PCT/GB2004/002253 dated Sep. 17, 2004.

* cited by examiner

*Primary Examiner*—Thomas E Lazo
(74) *Attorney, Agent, or Firm*—Daniel N. Lundeen; Lundeen & Lundeen, PLLC

(57) ABSTRACT

Apparatus and method for securing a cylinder liner to a pumping module. A first part of an assembly housing pistons is fastened to a pumping module and a second part of the assembly is brought against the first so that the pistons act on tensioning plates which each have a stud rod extending therefrom through the assembly at an end distal to the pumping module. Each rod has a first portion substantially surrounded in an elastomeric member and a second portion threaded to receive a nut. The rods are passed through a clamping ring on the cylinder liner and the nut is attached to the rod. Actuating the pistons causes initial compression of the elastomeric member by the tension plate and allows tightening of the nut toward the pumping module. Release of the pistons then causes expansion of the elastomeric member to forcibly compel the cylinder liner towards the pumping module.

17 Claims, 1 Drawing Sheet

LINER RETENTION SYSTEM

CROSS-REFERENCE TO RELATED APPLICATION

Figure 1:
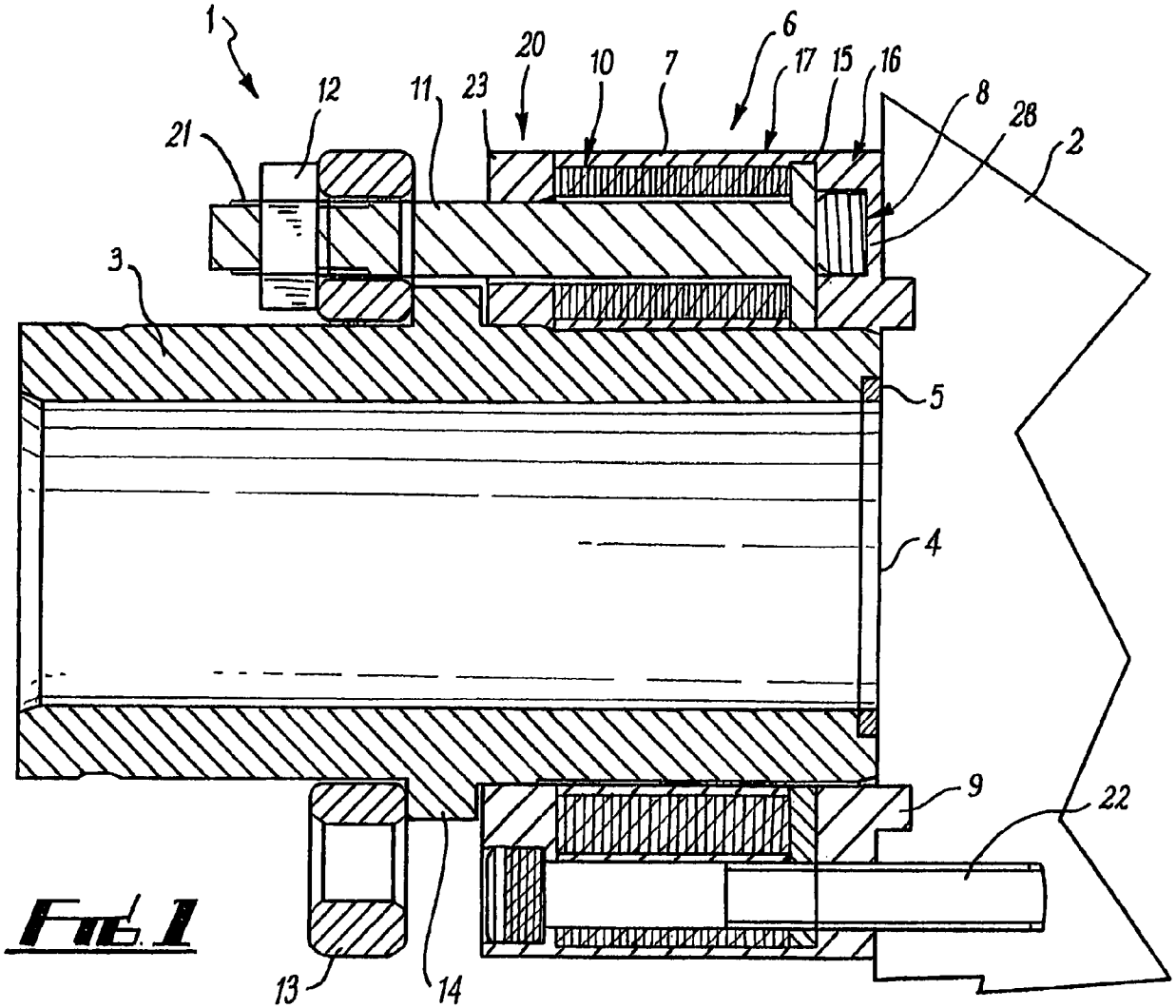

This application claims the benefit of and is a continuation of U.S. patent application Ser. No. 10/558,439, filed on Jul. 21, 2006, which is a U.S. national phase application, pursuant to 35 U.S.C. §371, of international application No. PCT/GB2004/002253, published in English on Dec. 9, 2004 as international publication No. WO 2004/106743 A1, which claims the benefit of British application Ser. No. GB 0312249.6, filed May 29, 2003, the disclosure of which applications are incorporated herein in their entireties by this reference.

This present invention relates to apparatus for aligning and securing cylinder liners to pumps and in particular, though not exclusively, to apparatus for aligning and securing cylinder liners of reciprocating pumps to their respective pumping modules.

In the past, there have been several different types of ways to attach cylinder liners to their respective pumping modules and these may vary according to make of pump in which they are used. One embodiment presently known employs a tapered concentric clamp, while another uses a concentric screw clamping arrangement.

It is important that the means for aligning and securing the cylinder liners may be implemented without undue effort and down-time. Cylinder liners are required to be changed frequently and this causes considerable inconvenience if the means and method for releasing the old cylinder liners and fitting the replacement cylinder liners are slow or difficult to operate. It has been found that original pump manufacturers' systems or means for securing cylinder liners to respective pumping modules have been difficult to operate for a plurality of reasons, including the involvement of heavy components, the handling of which may be dangerous for operators. These systems also require considerable strength, skill and reliability of operators, together with the use of heavy tools in confined spaces. Yet further, the securing force is dependent on the extent of wear and the general condition of a plurality of the securing components.

US RE37,483 has overcome some of these problems in providing an apparatus for securing a cylinder liner to a pumping module in a reciprocating pump which has a set of arrangements each with a hydraulically activated piston, a rod attached to the piston which is adapted to receive a nut, the retraction of which forcibly compels in attraction against a spring, the cylinder liner and the pumping module. In particular, this apparatus provides a tool which can be operated by hand. A further advantage is that the tool uses components which are considerably lighter than those of the prior art to ease handling.

However, excepting the nuts and clamping ring, the assembly of the apparatus must be completed prior to lifting and positioning on the pumping module. Thus although the individual components may be comparatively lighter, the combined weight of the assembled apparatus makes it difficult to handle. A further disadvantage of this apparatus is that the metal springs used may be prone to failure if the pump is instantaneously run at full speed. This is because a hydraulic shock is set-up through the pump which causes the springs to flatten and fracture by banging.

It is an object of at least one embodiment of the present invention to provide a liner retention tool which mitigates at least some of the problems of the prior art.

According to a first aspect of the present invention, there is provided an apparatus for securing a cylinder liner to a pumping module, the apparatus comprising one or more arrangements each fastened to said pumping module, each arrangement comprising an assembly including a piston, the piston acting on a tension plate, the tension plate having a stud rod extending therefrom out from the assembly at an end distal to the pumping module and thereon passing through a respective aperture in a clamping member adapted to grip the cylinder liner, the rod having a first portion substantially surrounded in an elastomeric member and a second portion threaded to receive a nut, wherein initial compression of the elastomeric member by the tension plate and tightening of the nut toward the pumping module, followed by release of the elastomeric member forcibly compel the cylinder liner towards the pumping module.

Preferably the elastomeric member comprises a multilayer structure having layers of flexible material interleaved with layers of strengthening material. The flexible material may be a rubber or the like. The strengthening material may be a metal, composite or other known material having a relatively high Young's modulus. In one embodiment the strengthening material may be a fabric reinforcement arranged through the elastomer.

Use of an elastomer prevents failure by hydraulic shock if the pump is started at full speed.

Preferably the assembly comprises at least two parts, a first part including the piston and a second part including the tensioning plate, rod and elastomeric member wherein the parts are separable for assembly and disassembly. Preferably the first part is located in a housing. The second part may also be located in a housing.

This separation of the parts provides for easier assembly over the prior art.

Preferably the/each piston is a hydraulic piston. More preferably the piston and a base of the housing define a space for accommodating hydraulic fluid.

Preferably also there are four arrangements arranged equidistantly around and externally of a circumference of the cylinder liner. Alternatively there are six arrangements arranged equidistantly around and externally of a circumference of the cylinder liner.

Preferably the clamping member comprises a clamping ring including the apertures for receiving the stud rods.

According to a second aspect of the present invention there is provided a method of securing a cylinder liner to a pumping module of a pump, the method comprising the steps:

(a) locating a first part of an assembly including a piston onto the pumping module;
(b) locating a second part of an assembly including an elastomeric unit and a stud bolt having a tension plate attached thereto, onto the first part;
(c) locating the cylinder liner against a seal on the pumping module;
(d) placing a clamping ring over the cylinder liner;
(e) inserting the stud bolt through an aperture in the clamping ring;
(f) placing a nut on a threaded portion of the stud bolt and locating the nut against the clamping ring;
(g) actuating the piston against the tension plate to compress the elastomeric member and force the stud bolt through the aperture;
(h) at full compression, tightening the nut against the clamping ring; and
(i) releasing the piston and by the expansion of the elastomeric member thereby sealing the cylinder liner to the pumping module.

The method may include the step of pumping hydraulic fluid to the piston to actuate the piston.

An example embodiment of the invention will now be described by way example only, with reference to the accompanying Figures, in which:

FIG. 1 is a cross-sectional view of an apparatus according to the present invention mounted on a pumping module with a cylinder liner.

A reciprocating pump generally described at 1 comprises a module 2 and cylinder liner 3. It is desirable that the cylinder liner 3 is securely held up against the face 4 of the module 2. Between the cylinder liner 3 and the module 2 there is-provided a seal 5 which, in its unenergized (i.e., uncompressed) state, must be compressed by the cylinder liner 3 to close a gap created between the adjacent faces of the module 2 and cylinder liner 3.

In order to prevent the existence of this gap, it is necessary to forcibly push the cylinder liner 3 against the module 2 and this is achieved by securing means, generally described at 6. The effect of compressing the cylinder liner 3 against the face 4 of the module 2 is to energise or compress the seal 5. This compression is of course desirable to increase the effectiveness and efficiency of the seal 5. The securing means 6 comprises one or more arrangements 20. Each arrangement includes an assembly comprising three parts abutted together; a first part 16, integral with a baseplate 9, located against the pumping module 2; a second part 17, the central portion, located against the first part; and a third part 20 located at an end distal to the pumping module 2 and abutted to the second part 17. The assemblies are enclosed in housings, generally indicated at 7.

The first part 16 houses a piston 8 which is hydraulically operated by the insertion of hydraulic fluid into a space 23 between the base of the piston and the rear face of the housing. In this way piston 8 may travel into the second part 17. The first part 16 is integral with the baseplate 9. The second part 17 is a cylindrical body into which is located an elastomeric member 10 and a stud bolt 11. The elastomeric member 10 has a cylindrical body and a bore passing therethrough. The elastomeric member 10 is made up of layers of a flexible material e.g. rubber and a strengthening material e.g. metal or fabric arranged perpendicular to the bore. The rod 11 has a tension plate 15 attached to one end and has a threaded portion 21 on the opposing end. The rod 11 is located through the bore of the elastomeric member 10 and extends from the housing away from the pumping module 2. Tension plate 15 has a circular face arranged to abut the piston 8 and an annular face arranged to abut a bottom face of the elastomeric member 10. The third part 23 of the housing 7 is a top cover plate having an aperture through which the rod 11 passes.

On exiting the housing 7 the rod passes over a lug 14 located on the cylinder 3 and through an aperture in a clamping ring 13 arranged around the cylinder. The threaded portion 21 of the rod 11 extends beyond the clamping ring 13 and a nut 12 is placed thereon.

In an alternative embodiment the housing 7 covers only the first part and the second and third parts are exposed.

In the embodiment shown, the securing means 6 includes one or more of arrangements 20 having the aforementioned components 7,8,10,11,12 and 15. The arrangement is permanently bolted by bolts 22 to the module 2, although the nuts 12 are detachable, thereby allowing removal of the cylinder liner 3.

Advantageously in assembling the securing means 6 to the pumping module 2, the baseplate 9 with the first part 16 of the housing can be separated from the remaining components of the housing. The remaining components can all be assembled individually. This reduces the need to manhandle heavy pre-assembled parts onto the pumping module 2.

In use, when a cylinder liner 3 is positioned against or nearly against the module 2, the shoulder or clamping ring 13 is then fitted over each of the stud rods 11. The nuts 12 are then threadably applied to the rods 11. The method of forcibly securing the cylinder liner 3 to the pumping module 2 is then implemented. This involves inserting hydraulic fluid into the space 23 between the head of piston 8 and the baseplate 9, such that the elastomeric unit 10 is compressed and rods 11 are extended to a greater extent outwith the top plate 23 of the housing 7 and the nut 12 is given freedom to be tightened by further rotation along rod 11 towards the clamping ring 13 simultaneously. The hydraulic fluid is then released from the space 23 so that the piston 8 retracts towards the module 2 and the elastomeric member 10 expands. The cylinder 3 is then secured against the module 2.

Preferably, the process of tightening the nuts 12 while compressing the elastomeric units 10 should be carried out sequentially around the arrangements 20. It should be noted that the apparatus and method described herein allows the nuts 12 to be tightened with light hand tools. It will be appreciated that this is a considerable advantage over the requirement of using heavy tools which was, in the past, required.

The invention thus provides components which are considerably lighter than comparative components used heretobefore. In view of negating the requirement of heavy tooling or handling, the components are less likely to be damaged during the removal or securing of cylinder liners and thus the invention permits greater repeatability and reliability. Furthermore, the need for intensive manual or skilled by operators is also mitigated. Similarly, there is a reduced danger of injury to operators or by-standers during such operational and maintenance functions.

It will also be appreciated that, because the apparatus can be readily dismantled into easily manually transportable components, installation in difficult locations can be safely carried out without the need for heavy lifting equipment. It is a feature of the invention that, by varying the composition and construction of the elastomer unit 10, a very wide range of operating duties can be met allowing accurate matching to each application. Additionally the use of an elastomer unit advantageously absorbs shock if the pumping module is switched on at a high rate.

Further modifications and improvements may be incorporated without departing from the spirit or scope of the invention. For example, though the invention has particular relevance to reciprocating pumps such as oil-field mud pumps, the invention is not, however, limited to mud pumps but finds application in a variety of reciprocating or positive displacement pumps.

Additionally, though the clamping ring in the embodiment described abuts a lug on the cylinder, cylinders without lugs may also be used with the invention.

The invention claimed is:

1. Apparatus for securing a cylinder liner to a pumping module, the apparatus comprising one or more arrangements each fastened to said pumping module, each arrangement comprising an assembly including a piston, the piston acting on a tension plate, the tension plate having a stud rod extending therefrom out from the assembly at an end distal to the pumping module and thereon passing through a respective aperture in a clamping member adapted to grip the cylinder liner, the rod having a first portion substantially surrounded by a biasing member and a second portion threaded to receive a nut, wherein initial compression of the biasing member by the tension plate and tightening of the nut toward the pumping module, followed by release of the biasing member forcibly compel the cylinder liner towards the pumping module.

2. Apparatus as claimed in claim 1 wherein the biasing member is a spring.

3. Apparatus as claimed in claim 1 wherein the biasing member is an elastomeric member.

4. Apparatus as claimed in claim 3 wherein the elastomeric member comprises a multi-layer structure having layers of flexible material interleaved with layers of strengthening material.

5. Apparatus as claimed in claim 4 wherein the flexible material is a rubber.

6. Apparatus as claimed in claim 4 wherein the strengthening material includes a metal.

7. Apparatus as claimed in claim 4 wherein the strengthening material comprises a fabric reinforcement.

8. Apparatus as claimed in claim 1 wherein the assembly comprises at least two parts, a first part including the piston and a second part including the tensioning plate, rod and elastomeric member wherein the parts are separable for assembly and disassembly.

9. Apparatus as claimed in claim 1 wherein the/each piston is a hydraulic piston.

10. Apparatus as claimed in claim 9 wherein the piston and a base of the first part define a space for accommodating hydraulic fluid.

11. Apparatus as claimed in claim 1 wherein there are four arrangements arranged equidistantly around and externally of a circumference of the cylinder liner.

12. Apparatus as claimed in claim 1 wherein there are six arrangements arranged equidistantly around and externally of a circumference of the cylinder liner.

13. Apparatus as claimed in claim 1 wherein the clamping member comprises a clamping ring including the apertures for receiving the stud rods.

14. A method of securing a cylinder liner to a pumping module of a pump, the method comprising the steps:

(a) locating a first part of an assembly including a piston onto the pumping module;

(b) locating a second part of an assembly including a biasing member and a stud bolt having a tension plate attached thereto, onto the first part;

(c) locating the cylinder liner against a seal on the pumping module;

(d) placing a clamping ring over the cylinder liner;

(e) inserting the stud bolt through an aperture in the clamping ring;

(f) placing a nut on a threaded portion of the stud bolt and locating the nut against the clamping ring;

(g) actuating the piston against the tension plate to compress the biasing member and force the stud bolt through the aperture;

(h) at full compression, tightening the nut against the clamping ring; and (i) releasing the piston and by the expansion of the biasing member thereby sealing the cylinder liner to the pumping module.

15. A method of securing a cylinder liner to a pumping module of a pump as claimed in claim 14 wherein the biasing member is a spring.

16. A method of securing a cylinder liner to a pumping module of a pump as claimed in claim 14 wherein the biasing member is an elastomeric member.

17. A method of securing a cylinder liner to a pumping module of a pump as claimed in claim 14 including the step of pumping hydraulic fluid to the piston to actuate the piston.

* * * * *